US007665944B2

(12) United States Patent
Guidroz

(10) Patent No.: US 7,665,944 B2
(45) Date of Patent: Feb. 23, 2010

(54) PIPE PICK-UP AND LAYDOWN APPARATUS AND METHOD

(76) Inventor: Perry J. Guidroz, 1060 Julie St., Breaux Bridge, LA (US) 70517

( * ) Notice: Subject to any disclaimer, the term of this patent is extended or adjusted under 35 U.S.C. 154(b) by 0 days.

(21) Appl. No.: 11/801,877

(22) Filed: May 11, 2007

(65) Prior Publication Data

US 2008/0038094 A1 Feb. 14, 2008

Related U.S. Application Data

(62) Division of application No. 11/089,706, filed on Mar. 24, 2005.

(60) Provisional application No. 60/602,970, filed on Aug. 18, 2004.

(51) Int. Cl.
*E21B 19/00* (2006.01)
*B66F 7/06* (2006.01)
*B66F 3/00* (2006.01)

(52) U.S. Cl. ..... 414/22.52; 187/211; 187/215; 254/124; 414/22.54; 414/589

(58) Field of Classification Search ..... 254/3 R, 254/10 R, 89 H, 3 C; 414/22.51–22.62, 22.65, 414/22.68, 22.69, 22.71, 589, 501, 746.1, 414/528, 590; 187/244, 269; 108/145; 182/69.5; 175/52

See application file for complete search history.

(56) References Cited

U.S. PATENT DOCUMENTS 2,535,546 A 12/1950 Pitts
2,576,907 A * 11/1951 Wallace ..... 187/211
2,617,547 A 11/1952 Pridy
2,643,006 A 6/1953 King
2,656,052 A 10/1953 Tucker
2,790,683 A * 4/1957 Clark ..... 108/145
2,922,533 A 1/1960 LaBarge, Jr.
3,053,401 A 9/1962 Jinkins, Jr.
3,254,776 A * 6/1966 Brown ..... 414/22.61
3,259,255 A * 7/1966 Cresci et al. ..... 414/590
3,559,821 A 2/1971 James
3,706,347 A 12/1972 Brown
3,792,783 A 2/1974 Brown
3,810,553 A 5/1974 Crocker et al
3,986,619 A * 10/1976 Woolslayer et al. ..... 414/22.55
4,054,210 A 10/1977 Crocker
4,158,524 A * 6/1979 Serafin ..... 414/678
4,235,566 A 11/1980 Beeman et al.
4,253,792 A * 3/1981 Nishikawa ..... 414/589
4,347,028 A 8/1982 Dugan
4,371,302 A 2/1983 Frias et al.

(Continued)

*Primary Examiner*—Gregory W Adams

(57) ABSTRACT

A method for lifting, stacking or otherwise manipulating a length of pipe is provided which includes the steps of providing a longitudinally orientated base frame; providing a movable carriage supported on the base frame, and providing a pipe lifting structure mounted to the carriage for independently supporting a length of pipe in a longitudinal position with respect to the base frame. The pipe lifting structure has first and second telescopically extendable lifting arm assemblies that are pivotally mounted to a longitudinally orientated pipe trough for supporting a length of pipe in the pipe trough. A means for pivotally raising and lowering the lifting arm assemblies and thereby said pipe trough and support length of pipe is provided. The method includes providing means for pivotally raising and lowering the lifting arm assemblies remotely located from the pipe lifting structure. Hydraulic cylinders and rams are provided to move the lifting structure.

12 Claims, 10 Drawing Sheets

U.S. PATENT DOCUMENTS

| | | | | | |
|---|---|---|---|---|---|
| 4,379,676 | A | | 4/1983 | Frias | |
| 4,382,738 | A | | 5/1983 | Frias | |
| 4,386,883 | A | | 6/1983 | Hogan et al. | |
| 4,403,898 | A | | 9/1983 | Thompson | |
| 4,426,182 | A | | 1/1984 | Frias et al. | |
| 4,439,091 | A | * | 3/1984 | Frias | 414/22.59 |
| 4,470,740 | A | | 9/1984 | Frias | |
| 4,494,899 | A | | 1/1985 | Hoang et al. | |
| 4,544,322 | A | * | 10/1985 | Booker | 414/589 |
| 4,552,498 | A | | 11/1985 | Dysarz | |
| 4,684,314 | A | * | 8/1987 | Luth | 414/746.1 |
| 5,122,023 | A | | 6/1992 | Mochizuki | |
| 5,451,129 | A | | 9/1995 | Boyadjieff et al. | |
| 6,079,925 | A | | 6/2000 | Morgan et al. | |
| 7,021,880 | B2 | | 4/2006 | Morelli et al. | |
| 2003/0123955 | A1 | * | 7/2003 | Eastcott | 414/22.54 |
| 2005/0152772 | A1 | * | 7/2005 | Hawkins, III | 414/22.54 |

* cited by examiner

PIPE PICK-UP AND LAYDOWN APPARATUS AND METHOD

This is a divisional application under 37 CFR 1.60 entitled "Pipe Pick-Up and Laydown Apparatus and Method". The pending prior application is Ser. No. 11/089,706 filed on Mar. 24, 2005 by applicant for "Pipe Pick-Up and Laydown Apparatus", the entire contents of which are hereby incorporated by reference. This application claims priority to prior application Ser. No. 11/089,706, which claims priority to U.S. Provisional Application Ser. No. 60/602,970 filed Aug. 18, 2004 by Applicant.

FIELD OF INVENTION

The present invention relates to a method and apparatus for manipulating a joint of pipe using a modular, self-contained, freestanding, portable pipe joint manipulating apparatus.

BACKGROUND OF INVENTION

Oil and gas drilling and production operations often require the use of long strings of pipe. Such pipe strings are typically comprised of individual segments or lengths of pipe called a pipe joint that are secured together. During such operations, individual pipe joints may be added or removed from a pipe string. These individual pipe joints are typically at least thirty feet in length and are extremely heavy. Consequently, some sort of pipe lifting apparatus is typically required as an aid for lifting, stacking or otherwise manipulating these pipe joints.

The present invention provides a method for manipulating a length of drill pipe or pipe joint using applicant's pipe pick-up and laydown apparatus. The proposed method provides for the use of a lifting apparatus in a self-contained, freestanding modular unit that is fully portable and easily operated. The method and apparatus of the present invention eliminates the complicated boom and cable systems as well as the cumbersome scissor jack lifting systems that have been typically employed in such lifting devices. The controls for Applicant's lifting device may be positioned at a point remote from the lift in order to place the device operator in a more secure environment.

SUMMARY OF INVENTION

The invention provides a longitudinally extending base frame assembly having a system of base rails or tracks, a movable carriage having a carriage frame and roller assembly for supporting the movable carriage on the frame base rails, and a pipe lifting structure that is mounted to this movable carriage. The carriage, and consequently the pipe lifting structure, is configured so that it may be moved as desired along the length of the base frame by means of the carriage rollers and base rail system to facilitate a desired lifting sequence.

The pipe lifting structure is further provided with a semicircular pipe support trough that is supported by first and second longitudinally spaced apart hydraulically driven telescopically extendable lifting arm assembles. The base end of each telescopically extendable lifting arm assembly is pivotally mounted to the carriage. The trough end of each lifting arm assembly is pivotally mounted to a lifting structure stabilizer frame that extends longitudinally between each lifting arm assembly.

Semicircular cradles or trough saddles are provided and positioned along the lifting structure stabilizer frame for supporting the pipe support trough. The pipe lifting trough is pivotally mounted at a point along its longitudinally axis to the ram of a trough lifting jack mounted to the lifting structure frame. The pipe support trough is further secured at its edges at the semicircular ends of each of the trough saddles of the lifting structure stabilizer frame by means of trough hinge assemblies having removable hinge pins. Selective removal and/or placement of the hinge pins of the trough hinge assemblies will allow the pipe support trough to be tilted to either side of the pipe lifting structure as may be desired by extension of the ram of the provided trough lifting jack.

An extendable and retractable ram mechanism is positioned between the first and second lifting arm assemblies and pivotally mounted to the carriage and to the first lifting arm assembly. In this manner an extension and retraction of the ram will raise, and lower as desired, the first lifting arm assembly, and the connected pipe trough, as it pivots at its carriage mounting end.

Because the second lifting arm assembly is connected to the first lifting arm by means of the pivotally connected lifting structure stabilizer frame, the second lifting arm assembly will also pivot at the carriage, follow the movements of the first lifting arm assembly and rise and fall as it supports the connected trough assembly. The pipe trough is tilted and lifted up in a swinging motion as the lifting arms are raised and lowed by extension and retraction of the carriage and lifting arm hydraulic ram assembly. The pipe trough may be further lifted, tilted or leveled by independent extension or retraction of the telescopically extendable first and second lifting arm assemblies.

It is thought that hydraulic cylinder means will be provided to extend the lifting arm and ram assemblies described herein though other means such a mechanically or electrically driven screw or ratchet mechanism may be utilized. It is also thought that an operator located at a centralized control point would control these mechanisms. Such a centralized control point would keep the operator away from the lifting areas and thus reduce the risk of injury to the operator. Electrical, hydraulic, pneumatic, or mechanical control systems, or combinations of these systems, may be employed to operate the lifting arm and ram assemblies.

Applicant's invention provides a pipe loading mechanism used to move pipe from a pipe rack to the pipe trough that employs hydraulically actuated lifting jack arms and a reversible pipe guide. The pipe guides may be reversed to change direction of the guide surface bumper so that pipe joints may be guided onto and then off of the pipe trough with the aid of the jack arms. The jack arms may be adjusted to different positions on the base rail to facilitate such lifts.

Applicant's invention provides a mechanism employed to roll the pipe joints out of the pipe trough. The mechanism employs the use of the aforementioned pipe trough/pipe saddle hinge and removable hinge pin mechanism. Selected removal and placement of the saddle and pipe trough hinge pins in association with the centrally positioned trough lifting jack described above will allow the pipe support trough to be tilted to either side of the pipe lifting structure as may be desired.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DRAWINGS

Reference Numerals

10 Apparatus
12 Base Frame
14 Base Support Rails
14A Rail Stops
15 Pipe Joint
16 Carriage
18 Support Roller Assembly
20 Pipe Lifting Structure
21 Lower Lifting Arm Columns
22 Pipe Support Trough
22A Trough Lift Bearing
23 Upper Lifting Arm columns
24 Telescoping Lifting Arm Assembly
25 Lifting Arm Extension Assembly
25A Lifting Arm Extension Jack
26 Telescoping Lifting Arm Assembly
28 Lifting Arm Base Bearing
30 Stabilizer Frame
32 Stabilizer Frame Bearing
34 Trough Saddles
36 Trough Lift
36A Trough Lift Ram
38 Trough Hinge Assembly
38A Saddle Hinge Links
38B Trough Hinge Links
38C Removable Trough Hinge Pins
40 Lifting Arm Lift Assembly
40A Lifting Arm Lift Ram
42 Lifting Arm Lift Ram Bearing
44 Pipe Loading Mechanism
46 Pipe Lifting Jack
48 Reversible Pipe Guide
52 Lifting Jack Strut
54 Bearings
56 Extendable Jack
58 Extendable Jack Ram
60 Pipe Lift
62 Upper Pipe Lift Support Bracket
63 Male Support Strut
64 Pipe Lift Lower Leg
65 Support Strut Socket
66 Bracket Bearing
68 Bracket Bearing
70 Lower Pipe Guide Frame
72 Pipe Guide Socket Column
74 Upper Pipe Guide Frame
76 Upper Pipe Guide Frame Legs
78 Pipe Guide Bar
80 Centralized Control Mechanism

DETAILED DESCRIPTION OF THE INVENTION

Figure 1:
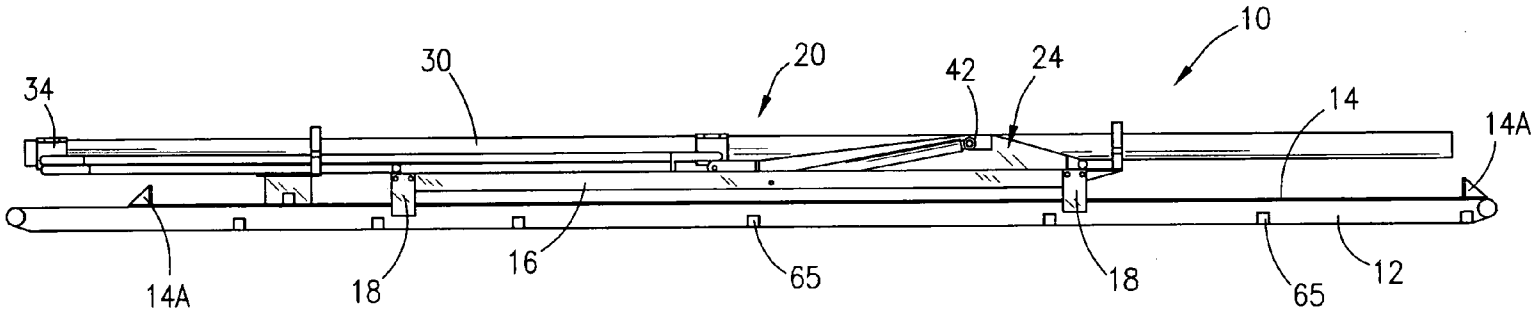
FIG. 1 is a side view of the Applicant's claimed invention with the lifting trough in a lowered position.

Referring now to the drawings and more particularly to FIG. 1, there is shown a side view of the pipe pick-up and laydown apparatus (10) of Applicant's invention. The apparatus (10) is comprised of a base frame (12) that supports a system of support rails (14). A movable carriage (16) is positioned on the support rails (14) by means of carriage support roller assemblies (18).

The carriage (16) may be moved along the system of support rails (14) by means of the roller assemblies (18) and a carriage propulsion mechanism (not shown) to place the carriage (16) in a desired position along the base frame (12) to facilitate a desired lifting position or sequence. Rail stops (14A) maintain the carriage (16) on the rail system (14).

It is thought that the carriage propulsion mechanism will employ the use of extendable and retractable hydraulic rams as the means to move the carriage (16) along the support rails (14). However, the carriage propulsion mechanism could also employ electrical, hydraulic, pneumatic or mechanical means, such as a motor driven pulley and cable system or a motor driven system of threaded rods and gears.

As can be seen in FIGS. 2-5, a pipe lifting structure assembly (20) is shown mounted to the movable carriage (16). The pipe lifting structure assembly (20) is comprised of a semicircular pipe support trough (22) for holding a length of pipe or pipe joint (15). The pipe support trough (22) is pivotally supported on a first telescopically extendable lifting arm assembly (24) and a second telescopically extendable lifting arm assembly (26) spaced apart from each other along the longitudinal axis of the carriage (16). Each telescopically extendable lifting arm assembly (24, 26) is pivotally mounted at its base to the carriage (16) by means of a lifting arm base hinged bearing (28).

Figure 6:
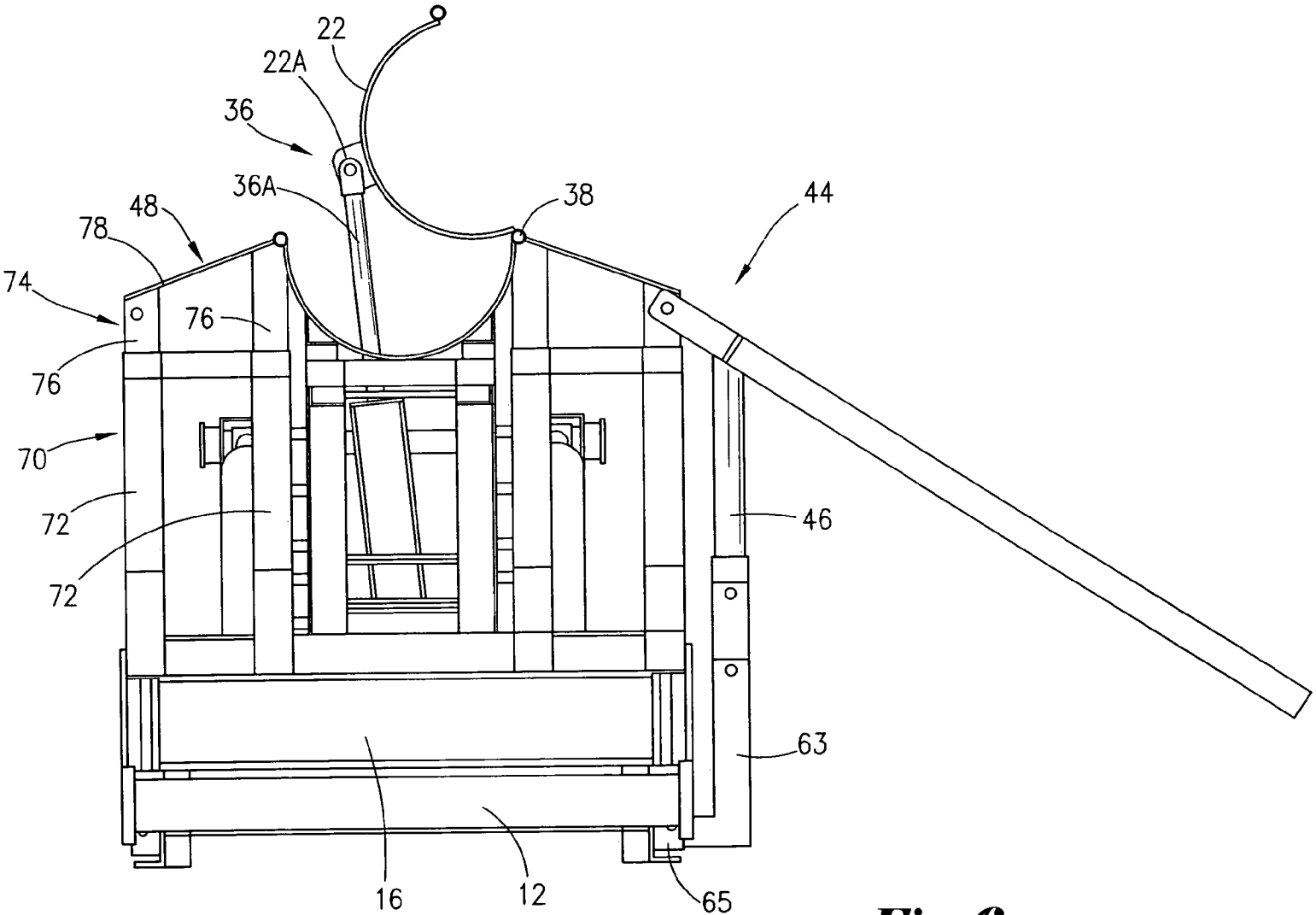
FIG. 6 is an end view of Applicant's claimed invention, showing the pivoting trough, pipe guide and pipe lifting jack.
Figure 7:
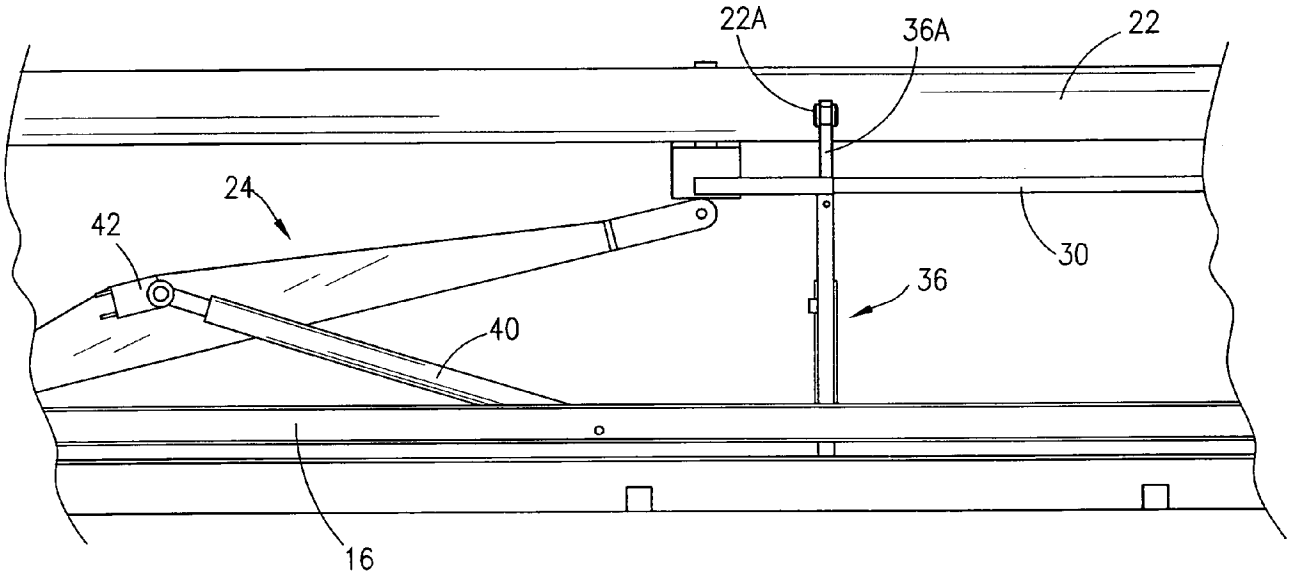
FIG. 7 is a partial side view of Applicant's claimed invention showing the pivoting trough and pipe lifting jack.

As shown in FIGS. 6 and 7, a lifting structure stabilizer frame (30) is pivotally attached to each telescopically extendable lifting arm assembly (24, 26) at the ends distal from the carriage (16) by means of stabilizer frame bearings (32). The lifting structure stabilizer frame (30) extends longitudinally along the trough (22). The lifting structure stabilizer frame (30) is provided with semicircular cradles or trough saddles (34) to support the trough (22) on the lifting structure stabilizer frame (30). A trough lift (36) is mounted to the lifting structure stabilizer frame (30). The trough lift (36) has an extendable ram (36A) pivotally attached to a trough lift bearing (22A) located below the trough (22) at a point on its longitudinal centerline axis.

Trough hinge assemblies (38) further secure the trough (22) to the stabilizer frame (30). These trough hinge assemblies (38) are comprised of saddle links (38A) mounted at the semicircular ends of each of the trough saddles (34), trough links (38B) mounted on the perimeter of the trough (22) and removable trough hinge pins (38C). Selective removal and/or placement of the hinge pins (38C), will allow the pipe support trough (22) to be tilted on the trough bearing assemblies, as it pivots on trough lift bearing (22A), to either side of the pipe lifting structure (20) as may be desired by the extension of the ram (36A) of the trough lift (36). In this manner pipe lifted in the trough (22) can be rolled from the trough (22) to either side of the lifting assembly (20) as may be required by a user.

As shown in the Figures, lifting arm lift assemblies (40) having an extendable and retractable rams (40A) are pivotally mounted to the carriage (16) positioned between the first (24) and second (26) lifting arm assemblies. The rams (40A) of each ram assembly are pivotally mounted to a bearing (42) on the first lifting arm assembly (24) in a manner such that when the rams (40A) are extended and retraced, the lifting arm assembly (24) will pivot on its lifting arm base hinged bearing (28). In this manner, extension and retraction of the rams (40A) will raise, and lower as desired, the first lifting arm assembly (24), and the connected pipe trough (22) will be lifted, as the lifting arm assembly pivots at the carriage (16) on the lifting arm base bearing (28).

Because the second lifting arm assembly (26) is connected to the first lifting arm assembly (24) by means of the pivotally connected lifting structure stabilizer frame (30), the second lifting arm assembly (26) will also pivot at the carriage (16) on its lifting arm bearing (28). Thus, the second lifting arm assembly (26) will follow the movements of the first lifting arm assembly (24) as imparted by the lift assemblies (40) and rise and fall as it supports the connected trough assembly (22). The pipe trough (22) will move in a swinging motion as the lifting arm assembly (26) is raised and lowed by extension and retraction of the ram (40A) of the ram assembly (40). The pipe trough (22) may be further lifted, tilted or leveled by independent extension or retraction of the telescopically extendable first and second lifting arm assemblies (24, 26).

Figure 10:
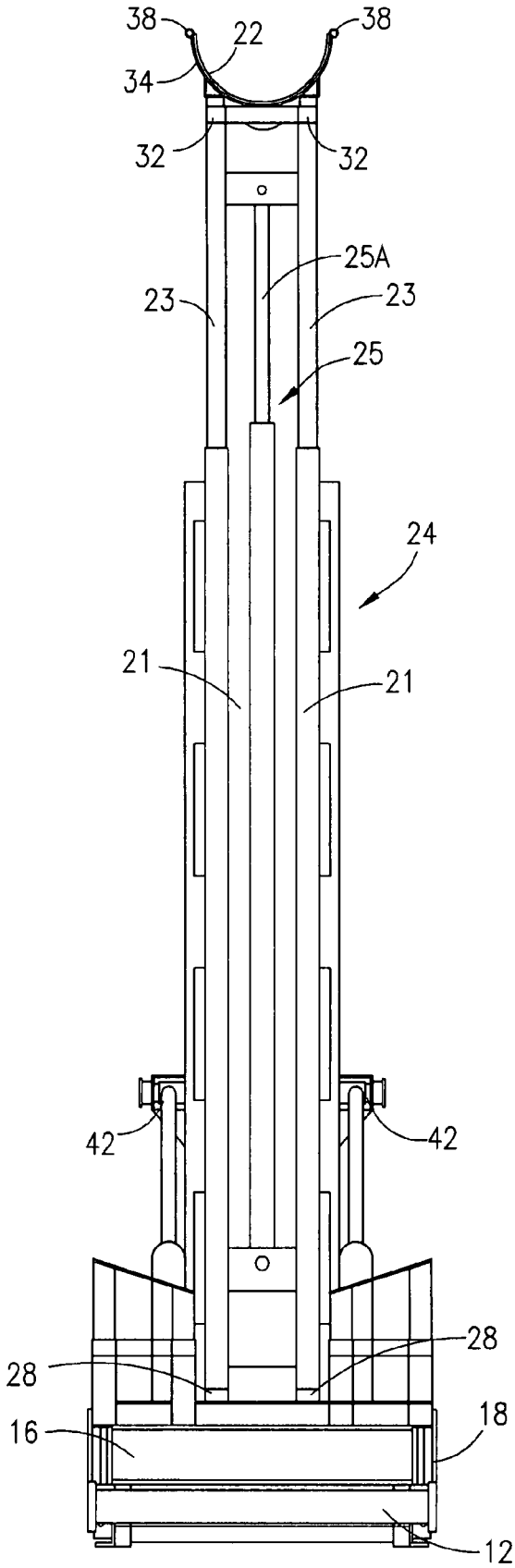
FIG. 10 is an end view of the first lifting arm assembly.

FIG. 10 shows an end view of the configuration of the telescoping lifting assembly (24). The assembly (24) is comprised of lower tubular columns (21) mounted to the lifting arm base hinge bearings (28). Corresponding retractable upper tubular columns (23) are inserted into the lower columns (21). The distal ends of the upper tubular columns (23) are mounted to the semicircular pipe support trough (22) by means of the lifting structure stabilizer bearings (32).

A central extendable lifting arm extension assembly (25) having an extendable jack (25A) is mounted to the hinge bearing (28) between the columns (21). The jack (25A) is also mounted to the lifting structure bearing (32). Extension or retraction of the jack (25A) will serve to extend the columns (23), which serve as a guide and support for the extension assembly (25). Retraction and extension of the jack (25A) will raise and lower the pipe support trough (22).

Lifting arm assembly (26) is similar to lifting arm assembly (24) and has a similar arrangement of columns (21) and (23) and bearings (28) and (32), along with a lifting arm extension assembly (25), to allow the attached pipe support trough (22) to be raised and lowered in the manner as described above. It is thought that hydraulic cylinder means will be utilized in the lift assembly (40) and in the extension assembly (25) to extend and retract the telescoping lifting arm described herein though other means such a mechanically or electrically driven screw or ratchet mechanism may be utilized.

Figure 8:
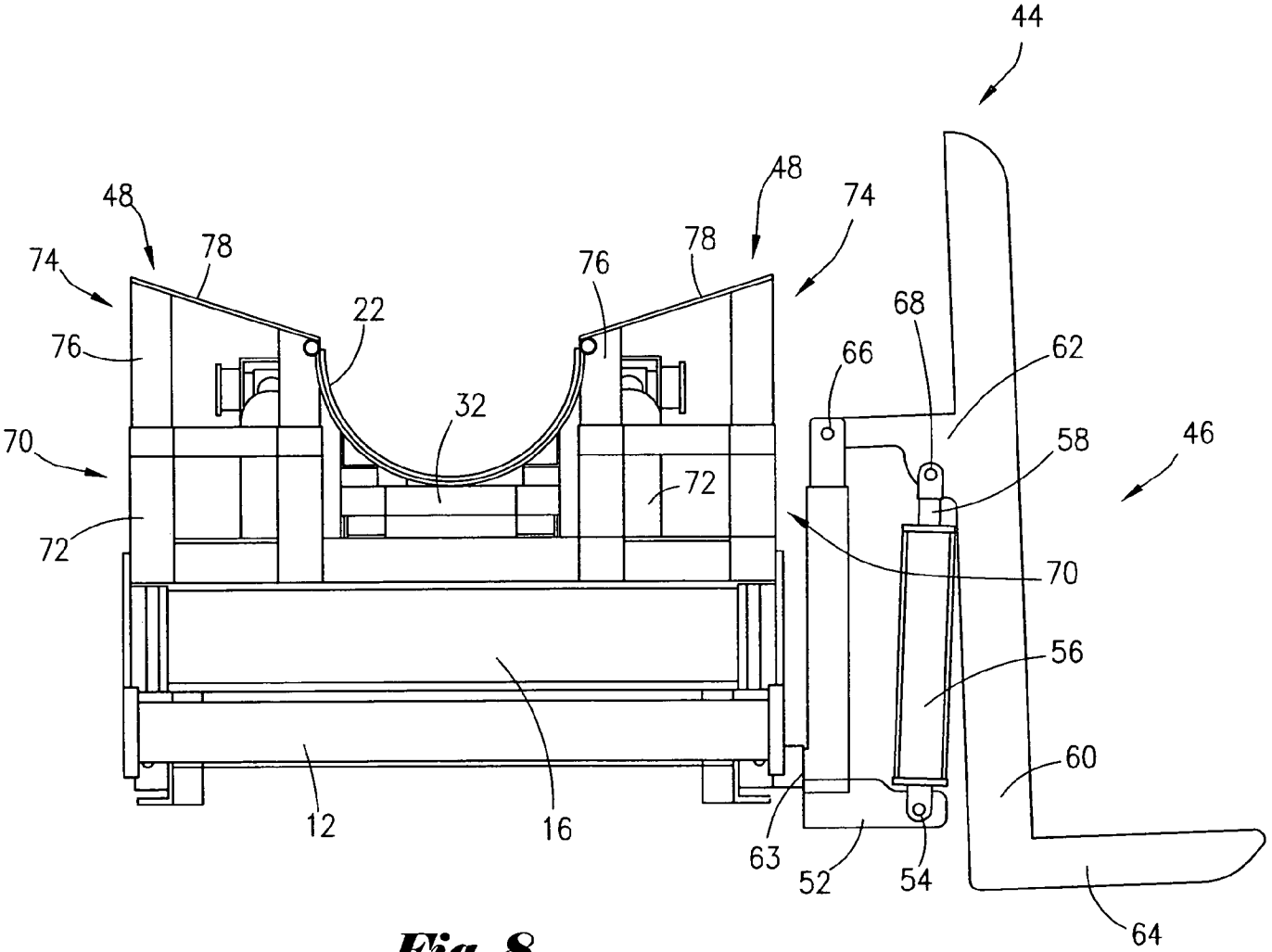
FIG. 8 is an end view of Applicant's claimed invention with the pipe guide in place and with pipe jack on the frame in a lowered position.
Figure 9:
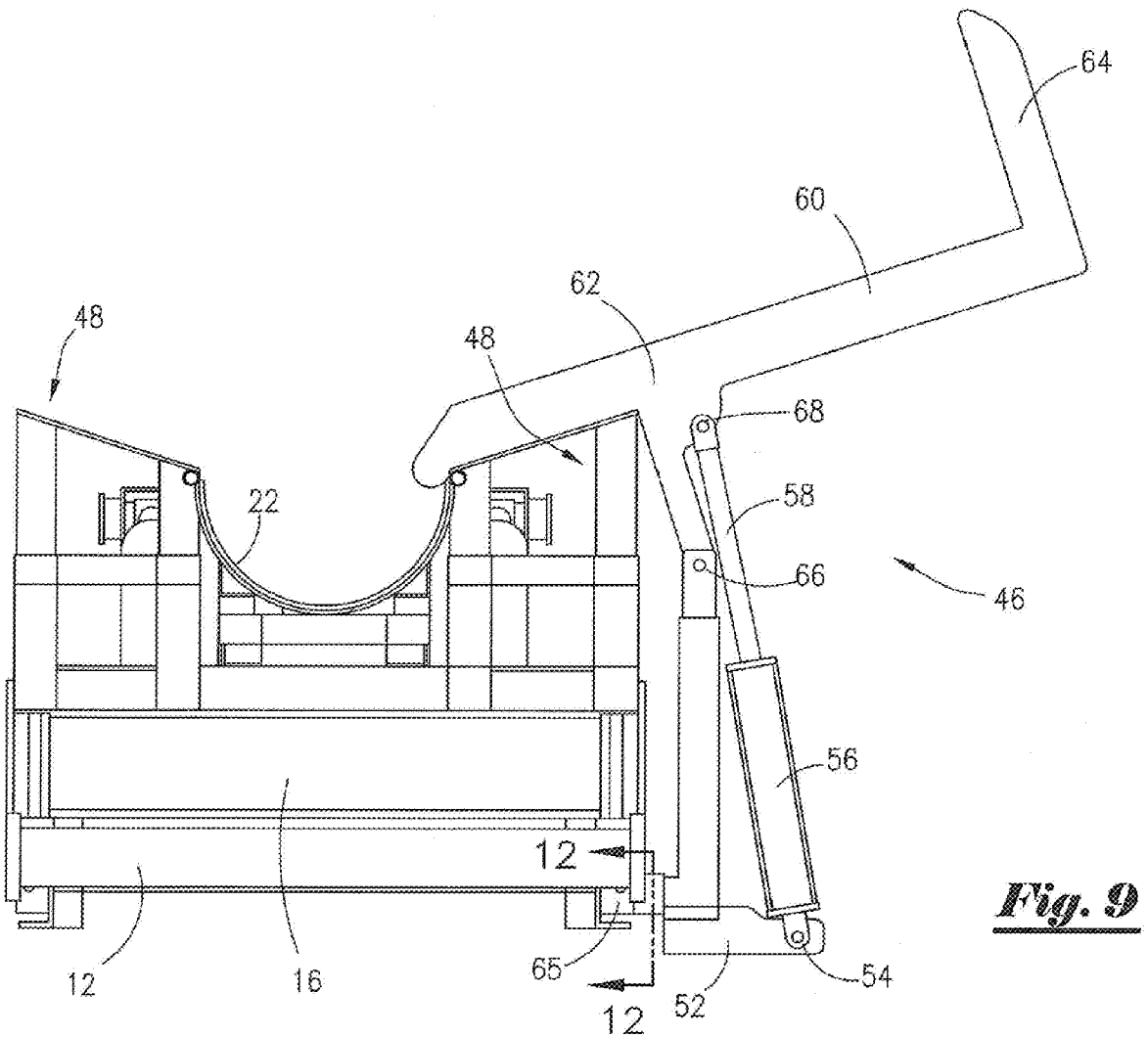
FIG. 9 is an end view of Applicant's claimed invention with the pipe guide in place and with pipe jack on the frame in a lifted position.

FIGS. 8 and 9 show the pipe loading mechanism (44). This mechanism employs a pipe lifting jack (46) and a reversible pipe guide (48). The pipe lifting jack (46) has an L-shaped strut (52) to which is pivotally mounted by means of bearings (54) an extendable jack (56) having a ram (58). An L-shaped pipe lift (60), having an upper support bracket (62) and an opposing lower leg (64), is pivotally mounted at the support bracket (62) of the L-shaped lift (60) on the strut (52) by bearing means (66). The ram (58) of the jack (56) is pivotally mounted by bearing means (68) to the support bracket (62) of the L-shaped pipe lift (60).

Extension and retraction of the ram (58) will raise the lower leg (64) of the pipe lift (60) as the leg pivots on the bracket bearings (66) and (68). Continued extension of the ram (58) will tilt the L-shaped pipe lift (60) into the guide plane of the pipe guide bar (78) of the pipe guide (48). In this manner, a pipe joint (15) may be lifted by the lower leg (64) of the pipe lift (60) and retained on the leg (64) as the pipe lift (60) is moved through its pivoting arc. Further extension of the ram (58) will allow a retained pipe to roll of the pipe lift (60) and onto the pipe guide bar (78) of the pipe guide (48) and then guided into the pipe trough (22).

Figures 12, 13:
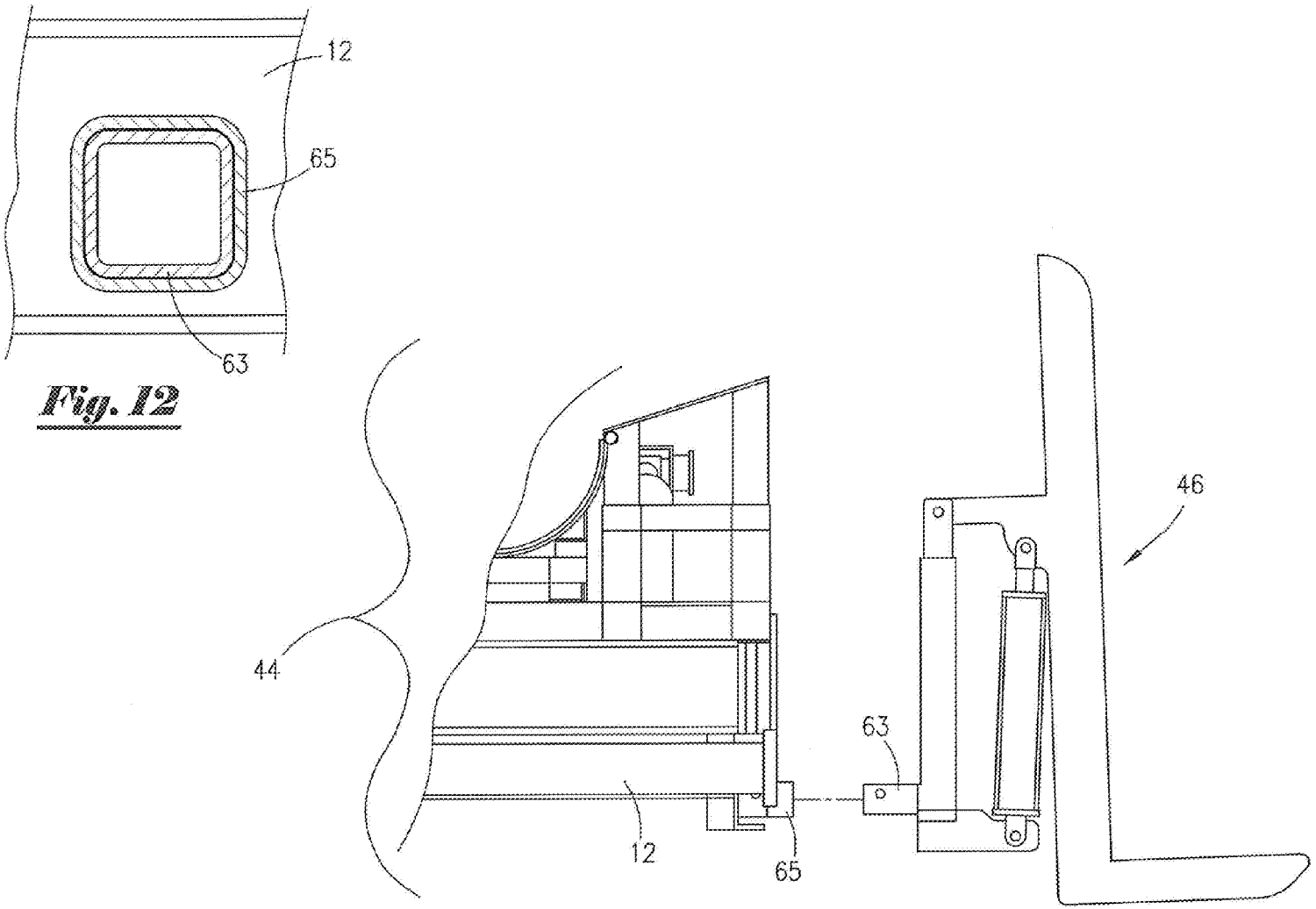
FIG. 12 is a cross sectional view of the pipe lifting jack along sectional line 12-12 of FIG. 9.
FIG. 13 is an exploded side view of the pipe lifting jack.

As shown in FIGS. 12 and 13. The pipe lifting jack (46) has a male support strut (63) adapted to fit into a female support strut socket (65) positioned on the base frame (12) of pick up and laydown apparatus (10). A number of support sockets (65) may be placed on the frame (12) in desired locations to allow the pipe lifting jack (46) to be positioned on the frame (12) as desired or to accommodate the use of multiple pipe lifting jacks (46).

The pipe guide (48) is comprised of a lower frame (70) having socket columns (72) mounted on the carriage (16). A corresponding removable upper frame (74) having legs (76) fits into the corresponding socket columns (72). The upper frame (74) is configured to support a diagonally orientated guide bar (78) on its legs (76). Reversing the orientation of the upper frame (74) and reinserting it into the socket columns (72) will change the orientation of the guide bar (78). This changes the direction of the guide bar (78) to slope to or from the pipe trough (22) so that a pipe joint (15) may be guided onto and then off of the pipe trough with the aid of the pipe lift (60).

Figure 11:
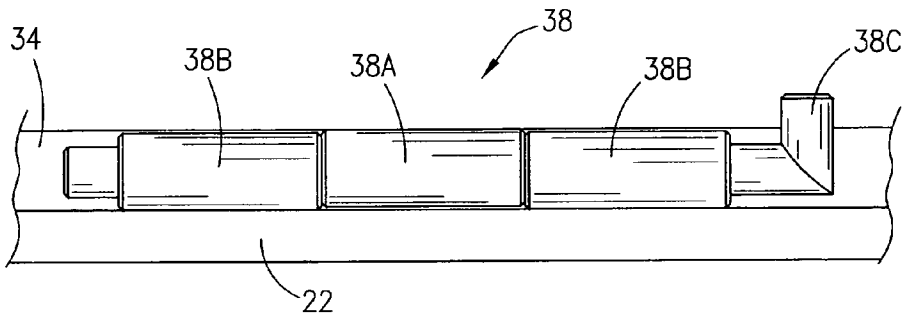
FIG. 11 is a top view of a Trough Hinge Assembly.

The trough hinge assemblies (38) are employed to roll a pipe joint (15) out of the pipe trough as shown in FIGS. 6 and 7. The trough hinge assemblies (38) secure the trough saddles (34) to the trough (22) by means of a removable trough pin (38C) inserted through the saddle links (38A) mounted to the edges of the trough saddles (34) and the corresponding trough links (38B) mounted at the edge of trough (22) as shown in FIG. 11. The hinge assemblies (38) are utilized on both ends of the trough saddles (34) at the sides of the trough (22).

Selective removal and/or placement of the hinge pins (38C) from the end of a trough saddle (34), at a desired side of the trough (22), will allow the pipe support trough (22) to pivot to the opposite side of the trough (22) by the extension of the ram (36A) of the trough lift (36) as it pivots on the trough bearing (22A). Continued extension of the ram (36A) will tilt the trough (22) over on the desired side of the pipe lifting structure (20). In this manner pipe lifted in the trough (22) can be rolled from the trough (22) to a floor surface or on to the pipe guide (50) as may be required by a user.

The lifting operation of the apparatus (10) is shown in FIGS. 1 through 5. It is contemplated that the entire apparatus (10) be operated by a system of hydraulic cylinders and rams and that these cylinders and rams will be remotely controlled from a control system positioned at a point away from the unit.

Figure 2:
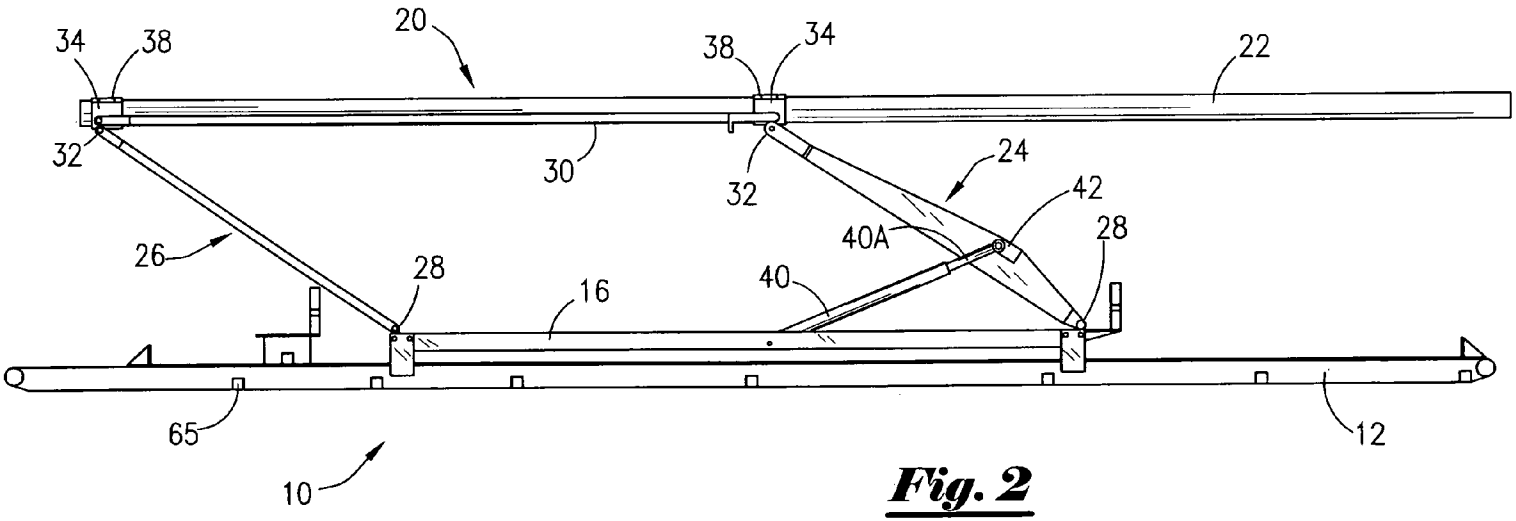
FIG. 2 is a side view of the Applicant's claimed invention with the lifting trough in an elevated position at the first stages of a lift.
Figure 3:
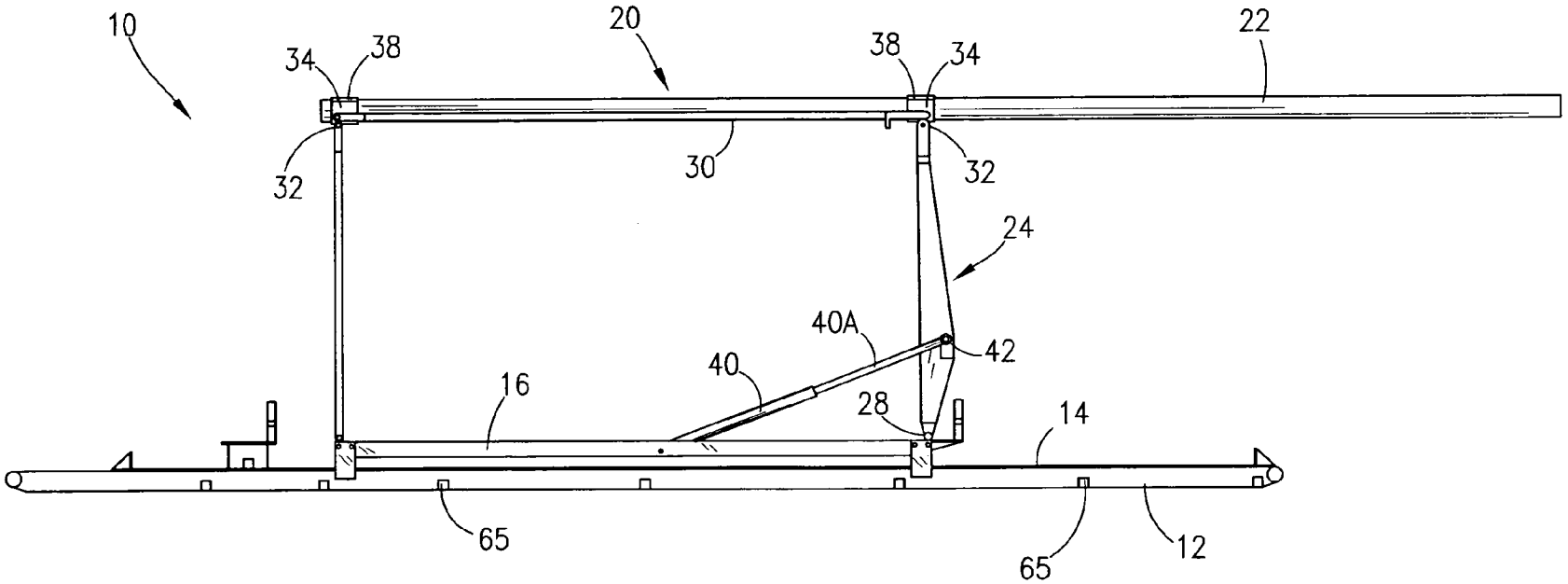
FIG. 3 is a side view of the Applicant's invention with the first and second lifting arm assemblies in a fully lifted position.

In FIG. 1, the apparatus (10) is positioned in a nested position with the lifting structure assembly (20) in its lowest position on the movable carriage (16). As shown in FIGS. 2 and 3, the extension of the rams (40A) will tilt up and lift the first telescoping lifting arm assembly (24) as it pivots on its bearing (28) and as a result the movable trough (22) will be lifted. Simultaneously, the second lifting arm assembly (26) will be pulled upward by the connected lifting structure stabilizer frame (30) causing the other end of the trough (22) to elevate. The lifting structure stabilizer frame (30) supports and stabilizes the movable trough (22) during operation.

Figure 4:
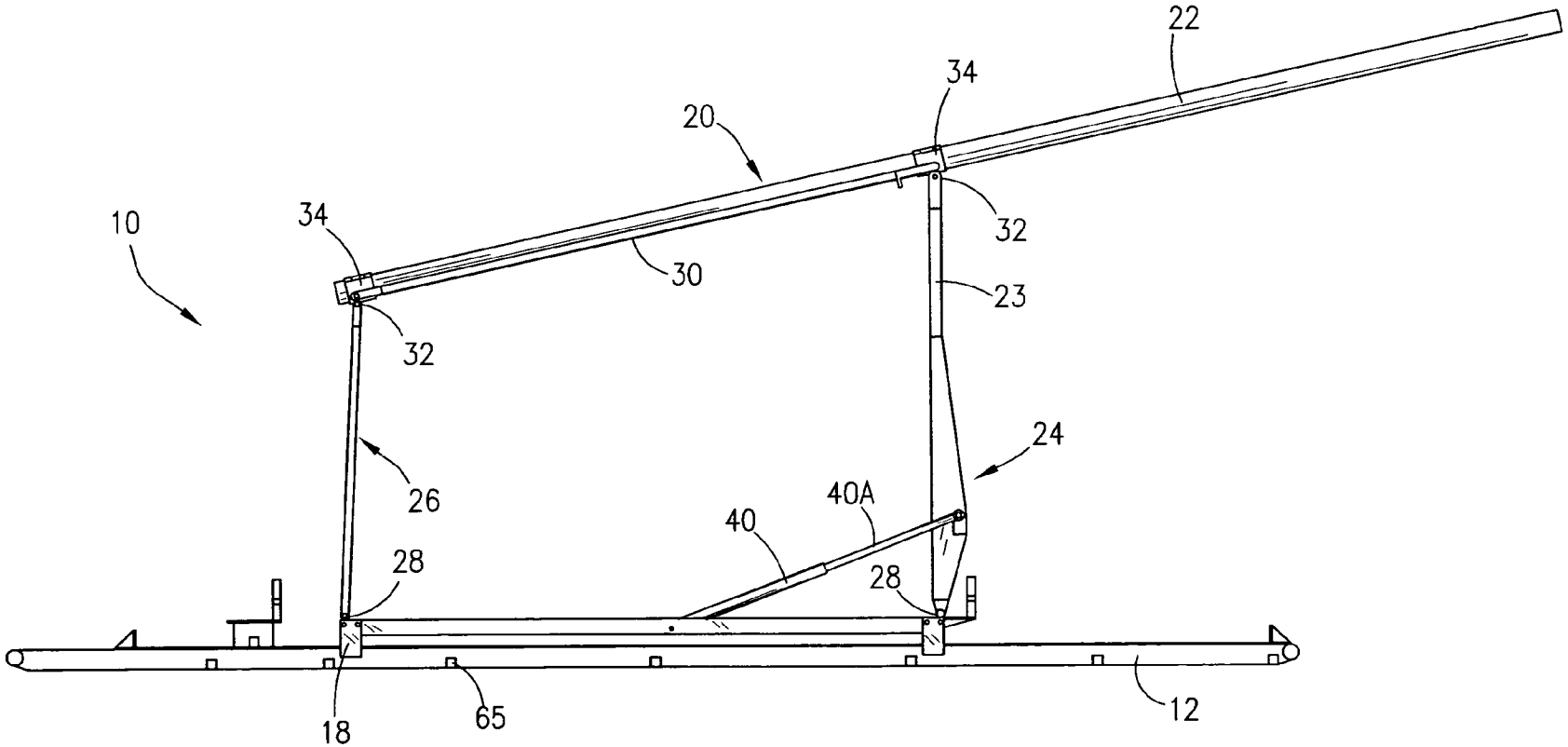
FIG. 4 is a side view of Applicant's claimed invention with the first lifting arm assembly in a lifted and extended position.
Figure 5:
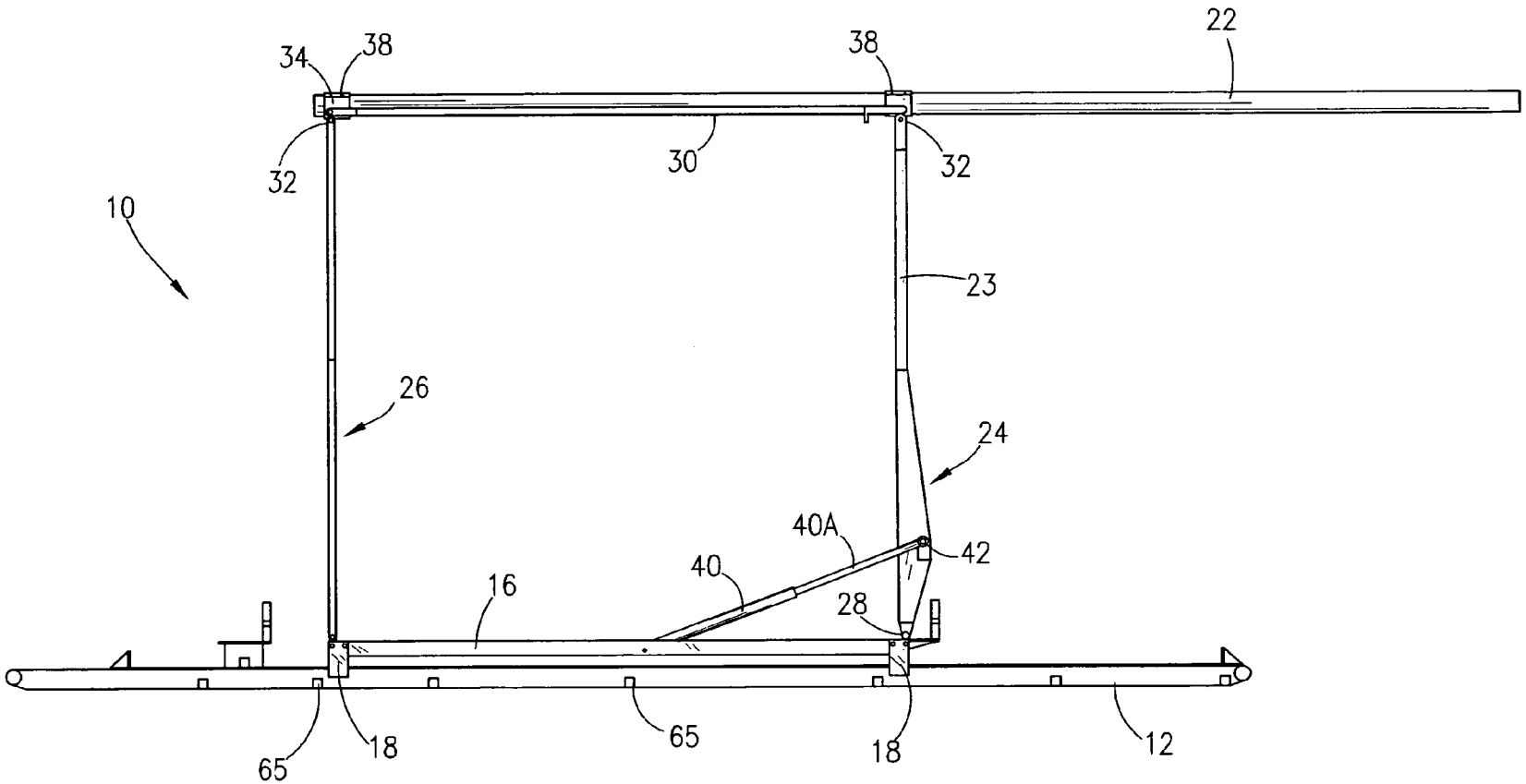
FIG. 5 is a side view of Applicant's claimed invention with the first and second lifting arm assemblies lifted and extended.

As shown in FIGS. 4 and 5, further elevation of the trough (22) may be made by extension of the first lifting arm assembly (24) as described above. Extension of the second lifting arm assembly (26) will result in lifting the trough (22) to a level position as shown in FIG. 5. In this manner the lift is accomplished to the full extension of the lifting arm assemblies (24, 26). Lifts to intermediate positions are accomplished by tilting the lifting arm assemblies (24, 26) to a desired level by means of the rams (40A), and then extending or retracting the lifting arms (24, 26) as desired by means of lifting arm extension assembly (25).

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method for lifting, stacking or otherwise manipulating a length of pipe comprising the steps of:

(a) providing a longitudinally oriented base frame;

(b) providing a movable carriage supported on said base frame;

(c) providing a longitudinally oriented pipe trough for supporting a length of pipe, said pipe trough spanning between first and second lifting arm assemblies, each of said lifting arm assemblies having first and second ends, said first ends of said lifting arm assemblies being pivotally mounted to said carriage, said second end of said lifting arm assemblies being pivotally mounted to said pipe trough;

(d) providing means to telescopically extend the length of at least one of said lifting arm assemblies independent from said other lifting arm assembly, wherein said means is a hydraulic ram;

(e) providing a length of pipe;

(f) placing said length of pipe on said pipe trough of said pipe lifting structure whereby said length of pipe is supported on side pipe trough in a longitudinal position with respect to said longitudinally oriented base frame;

(g) raising said pipe trough by raising said second end of said first lifting arm assembly and thereby raising said second end of said second lifting arm assembly while keeping said first lifting arm assembly substantially parallel to said second lifting arm assembly;

(h) telescopically extending the length of at least one of said lifting arm assemblies without extending the length of said other lifting arm assembly;

(i) removing said length of pipe from said pipe trough, wherein said step of removing said length of pipe from said pipe trough includes providing a means for pivoting said pipe through transversely with respect to said base frame, wherein said step of providing means for pivoting said pipe trough transversely with respect to said base frame includes providing at least one extendable and retractable hydraulic ram mounted to said pipe trough and extending and retracting said hydraulic ram whereby said pipe trough is pivoted so as to remove said length of pipe from said pipe trough and pivoting said trough transversely with respect to said base frame whereby said length of pipe is removed from said pipe trough;

(j) moving said carriage along said base frame, wherein said step of moving said carriage along said base frame includes providing at least one extendable and retractable hydraulic ram mounted to said carriage and to said base frame and extending and retracting said hydraulic ram whereby said carriage is moved along said longitudinal frame;

(k) providing at least one hydraulic ram mounted to said carriage and at least one of said lifting arm assemblies for pivotally raising and lowering said first and second lifting arm assemblies and thereby said pipe trough.

2. The method as recited in claim 1 further comprising the steps of:

(a) providing a lifting structure stabilizer frame located between said second ends of said lifting arm assemblies and said pipe trough, said lifting structure stabilizer frame being pivotally mounted to said second ends of said lifting arm assemblies and positioned to extend longitudinally with respect to said base frame between said first and second lifting arm assemblies;

(b) supporting said pipe trough on said lifting structure stabilizer frame;

(c) providing a plurality of female pipe jack sockets mounted longitudinally along said base frame;

(d) providing at least one pipe lifting jack, said jack having a strut to which is pivotally mounted an extendable and retractable hydraulic ram, said jack having a male support socket adapted to selectively mate with desired said female pipe jack sockets; and (e) mounting said pipe lifting jack on said base frame by mating said male support socket with a selected female support socket.

3. The method as recited in claim 2 wherein the step of providing means for pivoting said pipe trough transversely with respect to said base frame further comprises the steps of:

(a) providing a plurality of concavely configured, transversely oriented, saddles positioned along said stabilizer frame for transversely supporting said pipe trough;

(b) providing a hinge assembly mounted at each transverse end of said saddles;

(c) providing a hinge assembly mounted on said pipe trough to correspond with said hinge assembly on each of said saddles; and (d) providing a plurality of hinge pins corresponding to each of said hinge assemblies of said saddles and said pipe trough, said hinge pins being selectively insertable and removable from said corresponding hinge assemblies.

4. The method as recited in claim 3 further comprising the step of supporting said pipe trough on said saddles.

5. The method as recited in claim 4 further comprising the step of removing and inserting said hinge pins in said hinge assemblies whereby a direction in which said pipe trough is transversely pivoted is selected.

6. The method as recited in claim 5 wherein the step of providing at least one extendable and retractable hydraulic ram mounted to said pipe trough further comprises the steps of:

(a) mounting said extendable and retractable hydraulic ram mounted to said pipe trough on said stabilizer frame below said pipe trough for engagement of said pipe trough; and (b) extending and retracting said hydraulic ram, whereby said pipe trough pivots transversely with respect to said base frame.

7. The method as recited in claim 6 further comprising the step of rolling said length of pipe onto said pipe trough.

8. The method as recited in claim 7 wherein the step of rolling said length of pipe onto said pipe trough further comprising the step of extending and retracting said pipe lifting jack whereby said length of pipe is rolled onto and off of said pipe trough from said pipe lifting jack.

9. The method as recited in claim 8 further comprising the steps of:

(a) providing a reversible pipe guide for guiding said length of pipe as said length of pipe is transferred to and from said pipe trough by said pipe lifting jack; and (b) orienting said reversible pipe guide such that said pipe is rolled in a desired direction to and from said pipe trough.

10. The method as recited in claim 9 further comprising the step of attaching a plurality of said pipe lifting jacks to said base frame.

11. The method as recited in claim 10, further comprising the additional step of providing a centralized control point for controlling said means for moving said carriage along said frame, pivotally raising said pipe lifting structure, extending and retracting said first lifting arm assembly, and means for removing said length of pipe from said pipe trough.

12. The method as recited in claim 11, wherein in said centralized control point includes means for operating hydraulic rams.

* * * * *

US007665944C1

(12) EX PARTE REEXAMINATION CERTIFICATE (9955th)

United States Patent
Guidroz

(10) Number: US 7,665,944 C1
(45) Certificate Issued: Nov. 21, 2013

(54) PIPE PICK-UP AND LAYDOWN APPARATUS AND METHOD

(75) Inventor: Perry J. Guidroz, Breaux Bridge, LA (US)

(73) Assignee: Oilfield Innovators Limited, L.L.C., Lafayette, LA (US)

Reexamination Request:
No. 90/012,808, Mar. 19, 2013

Reexamination Certificate for:

| | |
|---|---|
| Patent No.: | **7,665,944** |
| Issued: | **Feb. 23, 2010** |
| Appl. No.: | **11/801,877** |
| Filed: | **May 11, 2007** |

Related U.S. Application Data

(62) Division of application No. 11/089,706, filed on Mar. 24, 2005, now Pat. No. 7,635,249.

(60) Provisional application No. 60/602,970, filed on Aug. 18, 2004.

(51) Int. Cl.

| | |
|---|---|
| ***E21B 19/00*** | (2006.01) |
| ***B66F 7/06*** | (2006.01) |
| ***B66F 3/00*** | (2006.01) |

(52) U.S. Cl.
USPC ..... 414/22.52; 187/211; 187/215; 254/124; 414/22.54; 414/589

(58) Field of Classification Search
USPC ..... 187/211, 215; 254/124; 414/22.52, 414/22.54, 589
See application file for complete search history.

(56) References Cited

To view the complete listing of prior art documents cited during the proceeding for Reexamination Control Number 90/012,808, please refer to the USPTO's public Patent Application Information Retrieval (PAIR) system under the Display References tab.

*Primary Examiner* — Jimmy G. Foster

(57) ABSTRACT

A method for lifting, stacking or otherwise manipulating a length of pipe is provided which includes the steps of providing a longitudinally orientated base frame; providing a movable carriage supported on the base frame, and providing a pipe lifting structure mounted to the carriage for independently supporting a length of pipe in a longitudinal position with respect to the base frame. The pipe lifting structure has first and second telescopically extendable lifting arm assemblies that are pivotally mounted to a longitudinally orientated pipe trough for supporting a length of pipe in the pipe trough. A means for pivotally raising and lowering the lifting arm assemblies and thereby said pipe trough and support length of pipe is provided. The method includes providing means for pivotally raising and lowering the lifting arm assemblies remotely located from the pipe lifting structure. Hydraulic cylinders and rams are provided to move the lifting structure.

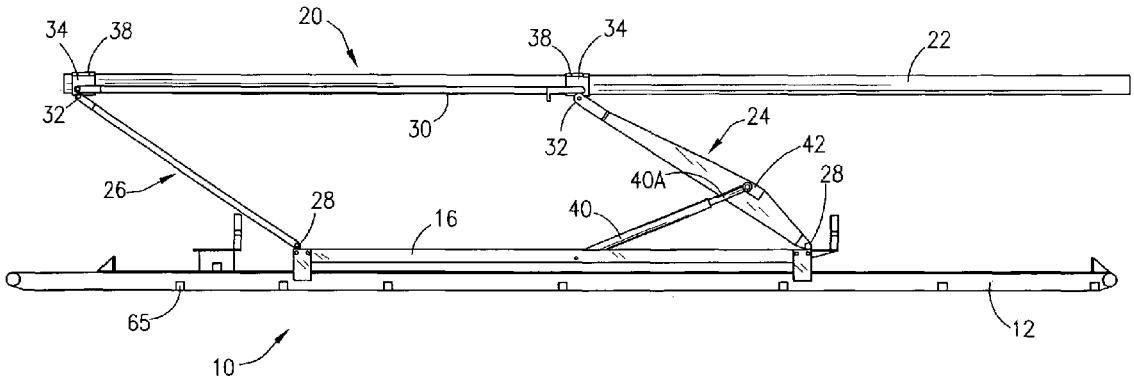

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-12 is confirmed.

* * * * *